United States Patent [19]

Morley

[11] Patent Number: 4,588,013

[45] Date of Patent: May 13, 1986

[54] BINDERS FOR FOUNDRY CORES AND MOULDS

[75] Inventor: John G. Morley, Kings Coughton, near Alcester, England

[73] Assignee: BCIRA, Birmingham, England

[21] Appl. No.: 717,682

[22] Filed: Mar. 29, 1985

[30] Foreign Application Priority Data

Apr. 12, 1984 [GB] United Kingdom ..... 8409494

[51] Int. Cl.[4] ..... B22C 1/16; B22C 9/12

[52] U.S. Cl. ..... 164/16; 164/528; 164/349; 164/369; 106/38.35

[58] Field of Search ..... 164/12, 16, 525, 528, 164/349, 369; 106/38.2, 38.35

[56] References Cited

U.S. PATENT DOCUMENTS 4,495,980 1/1985 Morley ..... 164/16

*Primary Examiner*—Kuang Y. Lin

*Attorney, Agent, or Firm*—Scrivener, Clarke, Scrivener and Johnson

[57] ABSTRACT

A binder for a foundry core or mould consists of an alkali metal salt of a polybasic organic acid or of a polymerized monobasic organic acid, for example sodium polyacrylate, an alkaline earth metal hydroxide such as calcium hydroxide, one or more polyvalent metal oxides, preferably magnesium oxide, and calcium citrate, together with water. The mixture may also include another polyvalent metal oxide, for example zinc oxide. The inclusion of calcium citrate in the binder composition, particularly in the presence of magnesium oxide, has been found to reduce the problem of 'softening back' in which the strength of the core or mould interior deteriorates over storage periods of a few days due to the continued absorption of carbon dioxide from the atmosphere in damp conditions.

13 Claims, No Drawings

BINDERS FOR FOUNDRY CORES AND MOULDS

Various processes are at present in use for binding together the grains of refractory material (generally sand) used to form foundry cores and, less often, moulds.

In our British patent application No. 8228716, GB publication No. 2 112 003, we describe a process in which a binder comprising an alkali metal salt of a polybasic organic acid or of a polymerised monobasic organic acid and an alkaline earth metal hydroxide is hardened by passing an acid gas through the refractory mixture, the preferred materials being sodium polyacrylate, calcium hydroxide and carbon dioxide respectively.

It has been found that the storage strengths of cores produced from mixtures described in GB 2 112 003 have been good provided that the cores have been stored in conditions in which the relative humidity did not exceed about 70 percent. At higher humidities relatively large cores of about 10 kg weight and above have shown a 'softening back' problem, in which the strength of the core interior has deteriorated over two or three day storage periods to such an extent that the interior sand became soft and damp. This can cause the cores to fracture in thin sections, or in areas of high stress during transport of the cores or when laying the cores in the mould.

The 'softening back' phenomenon has been shown to be associated with the continued absorption of carbon dioxide from the atmosphere in damp conditions.

It has now been found that this 'softening back' problem can be overcome by incorporating special additives in the binder composition. It was disclosed in GB No. 2 112 003 that additives of certain divalent or trivalent metal oxides to the sand mixture in addition to the alkaline earth metal hydroxide can improve core strength, the preferred metal oxide being magnesium oxide. Surprisingly, it has been found that another alkaline earth metal compound will reduce the 'softening back' problem.

According to the present invention there is provided a method of forming a foundry mould or core comprising adding to refractory particles a binder consisting essentially of an alkali metal salt of a polybasic organic acid or of a polymerised monobasic organic acid, together with an alkaline earth metal hydroxide and calcium citrate, with the addition of one or more polyvalent metal oxide or oxides, and water, the organic acid having a pKa of not less than 2.5, the alkali metal salt solution before addition of the alkaline earth metal hydroxide having a pH of not less than 5.7, and the total weight of the alkaline earth metal hydroxide, calcium citrate and polyvalent metal oxide or oxides comprising between 25 and 500 percent of the weight of the salt of the organic acid, and passing an acid gas through the resulting body.

For the reasons given in GB No. 2 112 003 the composition is preferably gassed with carbon dioxide. The alkali metal salt, preferably sodium polyacrylate, may be formed in the manner described in GB No. 2 112 003 so as to produce a solution having a pH of not less than 5.7. The preferred alkaline earth metal hydroxide is calcium hydroxide and the preferred polyvalent metal oxide is magnesium oxide.

Some reduction in the 'softening back' problem is obtained by the use of calcium citrate alone, but better results are obtained using zinc oxide and calcium citrate, and even better results are achieved using magnesium oxide with either calcium citrate or a mixture of calcium citrate and zinc oxide.

The relative proportions of the constituents can vary over quite a wide range. The total weight of alkaline earth metal hydroxide, calcium citrate and metal oxide or oxides is between 25 and 500 percent of the weight of the organic acid salt, and the metal oxide or oxides can form between 0 and 80 percent of these constituents.

The calcium citrate is preferably present in the binder to the extent of up to 1% of the total weight of the refractory particles.

Preferably, magnesium oxide is present in the binder to the extent of up to 2% of the total weight of the refractory particles.

Instead of, or in addition to the magnesium oxide, the calcium citrate may be present in a mixture with zinc oxide in the binder to the extent that the mixture comprises up to 1% of the total weight of the refractory particles.

In a typical example the refractory mixture may contain between 0.2 and 6 percent by weight of the alkali metal salt of the organic acid, added as a 10 to 70 percent solution in a liquid carrier. To this is added, in an amount from one quarter to five times the weight of the salt of the organic acid, a mixture of the alkaline earth metal hydroxide, preferably calcium hydroxide, calcium citrate and the polyvalent metal oxide or oxides.

The amount of liquid present in the sand mixture should be between 0.5 and 5 percent (by weight) which may be added either as a carrier for the alkali metal salt or by any other means.

The alkali metal salt of the organic acid is preferably present within the range of 0.5 to 1.5 percent of the total weight of refractory mixture.

In particular, foundry cores or moulds have been found to have improved storage behaviour over cores and moulds formed by the method described in GB No. 2 112 003 when they are formed by the addition to 100 parts of refractory particles (such as sand) of a binder composition comprising

| | |
|---|---|
| Sodium polyacrylate solution | 2–5 parts |
| Calcium hydroxide | 0.7–2 parts |
| Magnesium oxide | 0.1–2 parts |
| Calcium citrate or a mixture of calcium citrate and zinc oxide | 0.01–1.0 parts |

The sodium polyacrylate solution may be prepared to a pH in the range of between 5.7 and 12 but for best flowability a range of about pH 7–7.5 is preferred, and a small quantity of a non-ionic surfactant such as EMPIGEN BB may also be useful in the range of 0.05–2% of the polyacrylate solution.

In order to reduce the number of additions to the sand mixture to a minimum, the surfactant can be premixed with the sodium polyacrylate to form a stable solution. Similarly, the powder constitutents, calcium hydroxide, magnesium oxide and either calcium citrate or the mixture of calcium citrate and zinc oxide can be premixed to give a single homogeneous addition to the sand mixture.

Preferred ranges which have been used for the mixtures include the following

| | |
|---|---|
| Sand | 100 parts |
| Sodium polyacrylate solution | 3–3.5 parts |
| Calcium hydroxide | 1–1.3 parts |
| Magnesium oxide | 0.2–0.3 parts |
| Calcium citrate or a mixture of calcium citrate or zinc oxide | 0.05–0.15 parts |

The invention will now be further described with reference to a number of examples of compositions and the results of tests carried out on the compositions.

The test procedures and conditions used for assessing the extent of core deterioration in adverse storage conditions were as follows.

1. Accelerated Deterioration Tests

During the studies of the cause of the 'softening back' problem, it was found that the presence (even at low concentrations) of carbon dioxide in the storage environment was necessary to cause deterioration of the bond. A rapid test for improved sand mixtures was devised which exposed test cores to very severe storage conditions, accelerating any deterioration in strength, compared with normal foundry conditions.

The test involved placing 5.08 cm×5.08 cm AFS compression test pieces in sealed, heavy duty, polythene bags filled with carbon dioxide gas. Compression strengths of cores were measured "as-gassed" and after suitable periods of storage up to 1 week.

2. Tests on Large Cores

The core deterioration in poor storage conditions was mostly associated with medium to large cores weighing more than about 5 kg. Consequently some assessment work on promising binder compositions was carried out at BCIRA on a test core weighing 10 kg, and the interior strength of the core during storage was measured using the BCIRA impact penetration tester. The number of impacts at a spring loading of 133.4 N (30 lb), for each 1 cm of penetration into the core was measured daily. High impact penetration numbers indicated high core strengths and low numbers showed core deterioration. Total penetration for each test was 6 centimeters. After completion of the penetration tests cores were usually broken to examine the extent of softening in the core interior.

ACCELERATED DETERIORATION TESTS

Example 1

Core produced from a sand mixture prepared according to the teaching of GB No. 2 112 003

| | | |
|---|---|---|
| Chelford 60 sand | 4 kg | |
| Sodium polyacrylate solution | 120 g | (3%) |
| Calcium hydroxide | 52 g | (1.3%) |

The sodium polyacrylate solution was prepared according to the details given in Example 1 of GB No. 2 112 003 and neutralisation was carried out to pH 7.2. Also 0.2% (on resin weight) of a non-ionic surfactant (EMPIGEN BB) was added to improve sand flowability, in accordance with practice commonly employed in coremaking.

The sand mixture was made in a laboratory blade mixer, the polymer solution being added first to the sand and, after 1 minute mixing, followed by the calcium hydroxide powder.

5.08 cm×5.08 cm AFS compression test pieces were made by the standard procedure and were gassed with carbon dioxide (to harden them) for 20 seconds at 2.5 l/min as described in GB No. 2 112 003.

Half the prepared test pieces were stored in the open; half were stored in sealed polythene bags filled with carbon dioxide in which the atmosphere rapidly became saturated in water vapour.

| | Cores stored in air | | Cores stored in $CO_2$ | |
|---|---|---|---|---|
| | 20° C. | 60% RH | 20° C. | 100% RH |
| | Compression Strength | | | |
| Time | Pa × $10^6$ | (lb/in$^2$) | Pa × $10^6$ | (lb/in$^2$) |
| As-gassed | 1.234 | (179) | — | |
| 2 hours | 1.317 | (191) | 0.662 | (96) |
| 4 hours | 1.565 | (227) | 0.048 | (7) |
| 24 hours | 2.923 | (424) | 0.017 | (2.5) |
| 48 hours | 1.737 | (252) | 0.026 | (3.8) |

These results show the rapid deterioration occurring at high carbon dioxide levels in an 'unprotected' mix.

EXAMPLE 2

Improved Mixture

| | | | |
|---|---|---|---|
| Chelford 60 sand | 3 kg | | |
| Sodium polyacrylate solution | 90 g | (3%) | |
| Calcium hydroxide | 30 g | (1%) | premixed |
| Magnesium oxide | 9 g | (0.3%) | premixed |
| Calcium citrate | 3 g | (0.1%) | premixed |

The mixture and specimens were prepared as for Example 1.

| | Cores stored in air | | Cores stored in $CO_2$ | |
|---|---|---|---|---|
| | 20° C. | 60% RH | 20° C. | 100% RH |
| | Compression Strength | | | |
| Time | Pa × $10^6$ | (lb/in$^2$) | Pa × $10^6$ | (lb/in$^2$) |
| As-gassed | 0.724 | (105) | — | |
| 1 hour | 1.069 | (155) | 1.248 | (181) |
| 24 hours | 3.440 | (499) | 1.082 | (157) |
| 7 days | 4.909 | (712) | 1.179 | (171) |

This combination gave excellent storage strengths in the high humidity, high carbon dioxide atmosphere with no deterioration at all from the "as gassed" strength.

The benefits gained by use of the additive combination in Example 2 are shown by comparison with the following examples for the use of the new additions alone without the use of magnesium oxide.

EXAMPLE 3

| | | |
|---|---|---|
| Chelford 60 sand | 3 kg | |
| Sodium polyacrylate solution | 90 g | (3%) |
| Calcium hydroxide | 30 g | (1%) |
| Calcium citrate | 9 g | (0.3%) |

| | Cores stored in air | | Cores stored in $CO_2$ | |
|---|---|---|---|---|
| | 20° C. | 60% RH | 20° C. | 100% RH |
| | Compression Strength | | | |
| Time | Pa × $10^6$ | (lb/in$^2$) | Pa × $10^6$ | (lb/in$^2$) |
| As gassed | 1.206 | (175) | — | |
| 2 hours | 1.806 | (262) | 0.896 | (130) |
| 4 hours | 2.020 | (293) | 0.744 | (108) |

-continued

| | | | | |
|---|---|---|---|---|
| 24 hours | 2.868 | (416) | 0.079 | (11.5) |
| 48 hours | 2.930 | (425) | 0.031 | (4.5) |

EXAMPLE 4

| | | |
|---|---|---|
| Chelford 60 sand | 3 kg | |
| Sodium polyacrylate solution | 90 g | (3%) |
| Calcium hydroxide | 30 g | (1%) |
| Zinc oxide | 9 g | (0.3%) |
| Calcium citrate | 9 g | (0.3%) |

| | Cores stored in air | | Cores stored in $CO_2$ | |
|---|---|---|---|---|
| | 20° C. | 60% RH | 20° C. | 100% RH |
| | Compression Strength | | | |
| Time | Pa × $10^6$ | (lb/in$^2$) | Pa × $10^6$ | (lb/in$^2$) |
| As-gassed | 1.131 | (164) | — | |
| 1 hour | 1.792 | (260) | 1.131 | (164) |
| 24 hours | 3.426 | (497) | 0.648 | (94) |
| 96 hours | — | — | 0.414 | (60) |
| 8 days | — | — | 0.517 | (75) |

TESTS ON LARGE CORES

The results of Example 2 suggested that the use of magnesium oxide with calcium citrate as an addition to the basic mix which was disclosed in GB No. 2 112 003 would give particularly good core storage in damp environments in which high carbon dioxide levels might be expected, such as atmospheres in foundry coreshops where carbon dioxide gassing is used to cure cores.

The benefits of using mixtures containing calcium hydroxide, magnesium oxide and calcium citrate are confirmed by Example 6 compared with Example 5 in which the use of calcium hydroxide and magnesium oxide alone gave unsatisfactory strengths.

Three sand mixtures were therefore made with these additions and at least two 10 kg single barrel, cylinder block test cores were made from each mixture. The cores were gassed for a total of 20 seconds with carbon dioxide at a pressure of $2.76\times10^3$ Pa (40 p.s.i.) delivered through a 9.5 mm (⅜ in) diameter pipe (without special carbon dioxide flow control). Cores were tested at intervals with the impact penetration tester to assess the interior core strength. For each penetration test a new, 'untested' area of the cores was used.

EXAMPLE 5

Magnesium oxide alone

| | | |
|---|---|---|
| Chelford 60 sand | 36 kg | |
| Sodium polyacrylate solution | 1.08 kg | (3%) |
| Calcium hydroxide | 360 g | (1%) |
| Magnesium oxide | 108 g | (0.3%) |

Three 10 kg cores were made; one core was stored in open air; one core was stored in air (only) in a sealed bag (100% RH); and one core was stored in carbon dioxide (only) in a sealed bag (100% RH). All cores were stored at the same time in temperatures from −2° to 6° C.

| | | IMPACT PENETRATION NO. (impacts per cm. of penetration) | | | | | |
|---|---|---|---|---|---|---|---|
| Time | Storage Condition | 1 cm | 2 | 3 | 4 | 5 | 6 |
| As-gassed | | 11 | 12 | 12 | 12 | 12 | 12 |
| 24 hours | $CO_2$ | 24 | 35 | 34 | 33 | 21 | 22 |
| 24 hours | Open air | 1 | 4 | 5 | 4 | 2 | 3 |
| 24 hours | Air (in bag) | 1 | 3 | 3 | 2 | 2 | 0 |

These cores had deteriorated almost completely in air, so no further tests were carried out.

EXAMPLE 6

Magnesium oxide with calcium citrate

| | | | |
|---|---|---|---|
| Chelford 60 sand | 22 kg | | |
| Sodium polyacrylate solution | 660 g | (3%) | |
| Calcium hydroxide | 220 g | (1%) | premixed |
| Magnesium oxide | 44 g | (0.2%) | premixed |
| Calcium citrate | 22 g | (0.1%) | premixed |

Two 10 kg cores were made; one core was stored in the open air and one in carbon dioxide in a sealed bag, resulting in a relative humidity of 100%.

| | | IMPACT PENETRATION NO. (impacts per cm. of penetration) | | | | | |
|---|---|---|---|---|---|---|---|
| Time | Storage Condition | 1 cm | 2 | 3 | 4 | 5 | 6 |
| 24 hours | Open air | 16 | 22 | 25 | 30 | 34 | 30 |
| | $CO_2$ | 18 | 35 | 31 | 32 | 33 | 37 |
| 48 hours | Open air | 21 | 18 | 18 | 22 | 23 | 26 |
| | $CO_2$ | 18 | 31 | 28 | 28 | 25 | 27 |
| 5 days | Open air | 28 | 27 | 25 | 26 | 29 | 30 |
| | $CO_2$ | 20 | 37 | 27 | 29 | 36 | 36 |
| 8 days | Open air | 18 | 20 | 24 | 27 | 32 | 40 |
| | $CO_2$ | 5* | 11* | 16* | 17* | 17* | 20* |

Open air storage temp. −1° C., 90% RH

*This core at 100% humidity had not softened but had become more brittle and as the probe penetrated the core, so areas of core broke away apparently reducing the penetration number readings.

Example 6 shows the most successful combination of the additives for improving storage.

For comparison, in Example 7 the impact penetration numbers are given for 10 kg cores prepared from a sand mixture according to GB No. 2 112 003.

EXAMPLE 7

| | | |
|---|---|---|
| Chelford 60 sand | 22 kg | |
| Sodium polyacrylate solution | 660 g | (3%) |
| Calcium hydroxide | 220 g | (1%) |

Two 10 kg cores were made and stored as in Example 6.

| | | IMPACT PENETRATION NO. (impacts per cm. of penetration) | | | | | |
|---|---|---|---|---|---|---|---|
| Time | Storage Condition | 1 cm | 2 | 3 | 4 | 5 | 6 |
| 24 hours | Open air | 9 | 11 | 15 | 19 | 21 | 26 |
| | $CO_2$ | 0 | 0 | 0 | 0 | 0 | 0 |
| 48 hours | Open air | 8 | 14 | 18 | 22 | 25 | 27 |
| | $CO_2$ | 0 | 0 | 0 | 0 | 0 | 0 |
| 5 days | Open air | 2 | 0 | 4 | 5 | 3 | 2 |
| | $CO_2$ | 0 | 0 | 0 | 0 | 0 | 0 |
| 6 days | Open air | 0 | 0 | 3 | 9 | 10 | 15 |

-continued

| Time | Storage Condition | IMPACT PENETRATION NO. (impacts per cm. of penetration) 1 cm | 2 | 3 | 4 | 5 | 6 |
|---|---|---|---|---|---|---|---|
| | $CO_2$ | 0 | 0 | 0 | 0 | 0 | 0 |
| 1 week | Open air | 0 | 0 | 0 | 5 | 9 | 5 |
| | $CO_2$ | 0 | 0 | 0 | 0 | 0 | 0 |

For these cores storage in carbon dioxide led to complete bond destruction in only 24 hours. Even the core stood in the open air degraded within 5 days owing to absorption of carbon dioxide from the atmosphere.

I claim:

1. A method of forming a foundry mould or core comprising adding to refractory particles a binder consisting essentially of an alkali metal salt of a polybasic organic acid or of a polymerised monobasic organic acid, together with an alkaline earth metal hydroxide and calcium citrate, with the addition of at least one polyvalent metal oxide, and water, said organic acid having a pKa of not less than 2.5, said alkali metal salt solution before addition of the alkaline earth metal hydroxide having a pH of not less than 5.7, and the total weight of said alkaline earth metal hydroxide, calcium citrate, and said polyvalent metal oxide comprising between 25 and 500 per cent of the weight of said salt of said organic acid, and passing an acid gas through the resulting body.

2. The method of claim 1 wherein said gas is carbon dioxide.

3. The method of claim 1 wherein said polymerised organic acid is polyacrylic acid.

4. The method of claim 3 wherein said alkali metal salt is sodium polyacrylate.

5. The method of claim 1 wherein said alkaline earth metal hydroxide is calcium hydroxide.

6. The method of claim 1 wherein a finite amount of said polyvalent metal oxide is present in said binder to the extent (by weight) of up to 80% of the total weight of the constituents consisting of said alkaline earth metal hydroxide, calcium citrate and said metal oxide.

7. The method of claim 6 wherein said polyvalent metal oxide is magnesium oxide.

8. The method according to claim 7 wherein said magnesium oxide is present in said binder to the extent of up to 2% of the total weight of said refractory particles.

9. The method according to claim 1 wherein calcium citrate is present in said binder to the extent of up to 1% of the total weight of said refractory particles.

10. The method according to claim 6 wherein a mixture of zinc oxide and calcium citrate is present in said binder to the extent of up to 1% of the total weight of said refractory particles.

11. The method according to claim 1 wherein said alkali metal salt of said organic acid is added to the extent of between 0.2 and 6% of the total weight.

12. The method according to claim 11 wherein said alkali metal salt of said organic acid is added to the extent of 0.5 to 1.5% of the total weight.

13. A foundry mould or core formed by the method of claim 1.

* * * * *